US006296446B1

(12) United States Patent
Ishijima et al.

(10) Patent No.: US 6,296,446 B1
(45) Date of Patent: Oct. 2, 2001

(54) AXIAL BLOWER

(75) Inventors: Mitsuyoshi Ishijima; Tetsuya Koshitani; Satoshi Shimizu, all of Fuji (JP)

(73) Assignee: Toshiba Carrier Corporation, Tokyo (JP)

( * ) Notice: Subject to any disclaimer, the term of this patent is extended or adjusted under 35 U.S.C. 154(b) by 0 days.

(21) Appl. No.: 09/409,072

(22) Filed: Sep. 30, 1999

(30) Foreign Application Priority Data

Sep. 30, 1998 (JP) ..... 10-279116

(51) Int. Cl.[7] ..... F04D 29/38

(52) U.S. Cl. ..... 416/236 A; 416/236 R; 416/DIG. 2; 416/238

(58) Field of Search ..... 416/236 R, 236 A, 416/238, 223 R, 228, 243, DIG. 2, DIG. 5

(56) References Cited

U.S. PATENT DOCUMENTS 2,912,159 * 11/1959 Ganger et al. ..... 416/236 A
4,128,363 * 12/1978 Fujikake et al. ..... 416/236 A
5,169,290 * 12/1992 Chou ..... 416/236 R
5,193,983 * 3/1993 Shyu ..... 416/236 R

* cited by examiner

*Primary Examiner*—Edward K. Look
*Assistant Examiner*—Richard Woo
(74) *Attorney, Agent, or Firm*—Oblon, Spivak, McClelland, Maier & Neustadt, P.C.

(57) ABSTRACT

An axial blower includes a cylindrical hub, a driving device for rotating the cylindrical hub through a rotational shaft, a plurality of vanes arranged to an outer peripheral surface of the cylindrical hub in a circumferential direction thereof, and a plurality of stream-line ribs each having a stream-line shape and provided at a leading edge portion of a negative pressure surface-side of each of the vanes in a range from an end portion of the leading edge portion towards a trailing edge portion of the vane. The stream-line ribs are formed integrally such that an outer surface of a cross section of each stream-line rib along a rotational direction of the axial blower forms a circular arc and a radius of a circular arc curve of the outer surface at a vane leading edge side is larger than a radius of a circular arc curve at a vane inner surface side.

6 Claims, 6 Drawing Sheets

AXIAL BLOWER

BACKGROUND OF THE INVENTION

The present invention relates to an axial blower used for a blower of an outdoor unit of an air conditioner or the like.

One example of a conventional axial blower of this type is shown in, for example, FIG. 10. This axial blower 1 is provided with a plurality of vanes 3 formed integrally around a central hub 2 equidistantly in the circumferential direction thereof.

With reference to FIGS. 10–12, the cross-sectional shape of each vane 3 in the circumferential direction A-B at a portion having a radially arbitrary distance D from the center O of the hub 2 is formed into a thick stream-line shape 3*d* from the negative pressure surface-side leading edge portion 3*a* of the vane 3 to a vane surface 3*c* as shown in FIG. 11.

The thick shape 3*d* advantageously allows an air flow F flowing from the negative pressure surface-side leading edge portion 3*a* of the vane 3 to travel along the positive and negative pressure sides of the vane surface 3*c* as indicated by arrows shown in FIG. 12, prevents the air flow F from separating from the vane surface 3*c* and makes small a trailing vortex Vf formed in the back of a vane trailing edge portion 3*b* thereby to reduce a blowing sound.

When the conventional axial blower 1 as mentioned above is incorporated, as a blower, into the outdoor unit of an air conditioner to increase the number of revolution of the blower per unit time (to be simply referred to as "the number of revolution" hereinafter) and to increase the quantity of blast, following disadvantages occur. That is, static pressure in the outdoor unit rises, the inflow angle of the air flow F with respect to the negative pressure surface-side leading edge portion 3*a* of each vane 3 varies and the separation of the air flow tends to occur on the vane surface 3*c*, thus increasing the blowing sound.

Further, it is easily be understood that the term "negative pressure side" used herein means an air-sucking side and the term "positive pressure side" used herein means an air-blowing side with respect to the vanes of the axial blower.

SUMMARY OF THE INVENTION

An object of the present invention is to substantially eliminate defects or drawbacks encountered in the prior art mentioned above and to provide an inexpensive axial blower capable of suppressing the increase of blowing sound due to the separation of a flow generated on the negative pressure surface side of the vane and has excellent formability.

This and other objects can be achieved according to the present invention by providing an axial blower comprising:

- a cylindrical hub;
- a driving means for rotating the hub through a rotational shaft;
- a plurality of vanes arranged to an outer peripheral surface of the hub in a circumferential direction thereof; and
- a plurality of ribs, each having a stream-line shape, provided at a leading edge portion of a negative pressure surface-side of each of the vanes in a range from an end portion of the leading edge portion towards a trailing edge portion of the vane.

In a preferred embodiment, each of the stream-line ribs has a central axis along a blower rotational direction, the central axis passing a point of intersection of a circular arc having a center point of a circular arc portion on a vane outer periphery leading edge-side and the vane leading edge portion and being substantially in parallel to a tangent of the circular arc.

The plurality of stream-line ribs are arranged with equal distance from each other and the distance between the adjacent stream-line ribs is set at L/12 with respect to a length L of the negative pressure surface-side leading edge portion along a radial direction of the axial blower. The stream-line ribs are formed integrally such that an outer surface of a cross section of each rib along the rotational direction of the axial blower forms a circular arc and a radius of a circular arc curve of the outer surface at a vane leading edge side is larger than a radius of a circular arc curve at a vane inner surface side.

The stream-line ribs have lengths k at a vane outer periphery side along the rotational direction of the air blower are set equal to one another. The lengths k of the stream-line ribs at the vane outer periphery side along the rotational direction of the axial blower are set to satisfy a relation of k:CL=1:9, where CL is a chord length of the vane outer periphery.

A height of the cross-section of each of the ribs along a thickness direction of each of the vanes is changed to be made gradually larger from the hub side towards the vane outer periphery direction in a manner reverse to that a thickness of a cross section of the vane leading edge portion is made gradually smaller from the hub side towards the direction of the vane outer periphery.

The plurality of stream-line ribs include a rib closest to the vane outer peripheral side having a height h, and a rib closest to the hub side of a stream-line rib closest to the vane outer periphery side having a height $h_2$, the heights being set so as to satisfy an equation $h_1=2h_2$.

According to the present invention of the structures mentioned above, in the main aspect, the plural stream-line ribs at the negative pressure surface-side leading edge portion of each vane accelerate the transition of a laminar flow to a turbulent flow above a vane surface boundary layer of each vane. The flow above a turbulent flow boundary layer is less separated than that above the laminar boundary layer. Thus, it is possible to both enhance blast performance and reduce blowing noise.

In the other aspects of the embodiment, each of the stream-line ribs is arranged such that a central axis of the rib along a rotation direction of the blower passes a point of intersection of a circular arc about a center of a vane outer periphery leading edge-side circular arc portion and the vane leading edge and is parallel to a tangent of the circular arc. Accordingly, when an air-flow flowing from the negative pressure surface-side leading edge of each vane passes the stream-line ribs, the air-flow forms longitudinal vortex rows thereby to make the transition of a layer above the vane surface to a turbulent boundary layer. This action can make narrow the widths of the trailing vortexes which cause the blowing sound and can reduce the blowing sound.

The plural stream-line ribs are arranged equidistantly and the distance between the stream-line ribs is set at L/12 with respect to a length L of the negative pressure surface-side leading edge portion along a radial direction of the blower. Accordingly, even if static pressure within the blower increases and the inflow angle of the air-flow at the negative pressure surface-side leading edge portion of each vane is changed, the blowing sound can be reduced.

Furthermore, if the radius of a circular arc curve thereof at a vane leading edge side becomes larger than that of a circular arc curve at a vane inner surface side on the circular arc cross section of each stream-line rib along the rotational direction of the blower, longitudinal vertexes generated when air flows pass through the stream-line ribs can be generated stably and the blowing sound reduction effect can be further improved.

Still furthermore, since, the lengths k of the stream-line ribs at the vane outer periphery side along the rotation direction of the air blower are set to satisfy k:CL=1:9 where CL is a chord length of the vane outer periphery, the blowing sound reduction effect can be maximized.

Still furthermore, since the thickness of the vane leading edge portion is changed so as to be gradually smaller from the hub side toward the vane outer periphery side, if the height h of each stream-line rib is changed so as to be gradually larger from the hub side towards the vane outer peripheral direction oppositely from the change of the vane thickness, and the height $h_1$, of the stream-line rib at the vane outer periphery side and the height ha of the stream-line rib at the hub side are formed to satisfy the relationship of $h_1=2h_2$, then the thickness of the cross section including the thickness of the negative pressure surface-side leading edge portion becomes equal in any points. Accordingly, it is possible to shorten a cooling time and reduce the shrinkage of the vane while integrally forming the axial blower with a resin or like.

The nature and further characteristic features of the present invention will be made more clear from the following description made with reference to the accompanying drawings.

DESCRIPTION OF THE PREFERRED EMBODIMENTS

One preferred embodiment according to the present invention will be described hereunder with reference to FIGS. 1 through 9.

Figure 2:
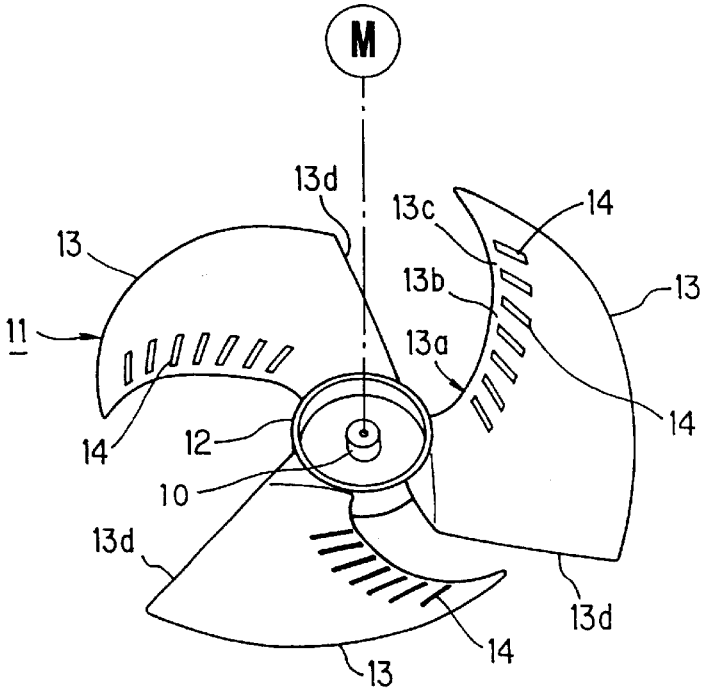
FIG. 2 is a perspective view of the axial blower as viewed from the negative pressure surface side of the vane.

FIG. 2 is a perspective view of an axial blower 11 in a first embodiment according to the present invention as viewed from a negative pressure surface side.

As mentioned hereinbefore, in the described embodiment, it will be also easily understood that the term "negative pressure side" used herein means an air-sucking side and the term "positive pressure side" used herein means an air-blowing side with respect to the vanes of the axial blower.

Figure 1:
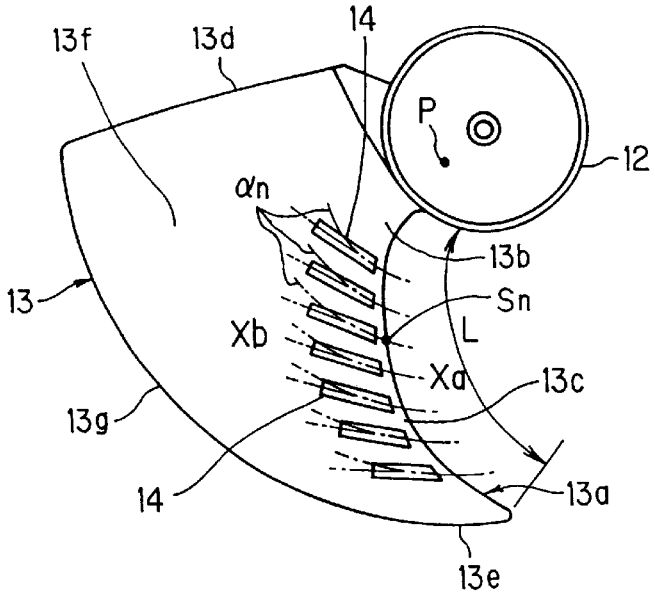
FIG. 1 is a front view, partially removed, of an axial blower according to one embodiment of the present invention as viewed from a vane negative pressure surface side of an axial blower shown in FIG. 2, mentioned latter.

FIG. 1 is a partially omitted front view of the axial blower 11 of FIG. 2 at the negative pressure surface side. The axial blower 11 is provided with a central cylindrical hub 12 and a plurality of vanes 13 formed integrally with the hub 12 equidistantly on the outer peripheral surface in the circumferential direction thereof. The central hub 12 is coupled with a rotation shaft 10 of a driving motor M, such as electric motor, so as to be rotated thereby.

As also shown in FIG. 1, the axial blower 11 has a plurality of ribs 14, each having a stream-line shape, smoothly ranging from a leading edge fillet 13*c* towards a trailing edge portion 13*d* on the negative pressure surface side leading edge portion 13*b* of the leading edge portion 13*a* of each of the vanes 13. The stream-line ribs 14 are aligned to have a predetermined distance from each other in the radial direction of the axial blower 11.

The stream-line ribs 14 are arranged in the following manner. That is, providing that a center of the leading edge side circular arc portion 13*e* on the outer periphery of the vane is referred to as "P", the ribs 14 pass points of intersections Sn of a plurality of arcs $\alpha$ n of concentric circles of different diameters with the center P being the center of the circles and the leading edge end of the leading edge fillet 13*c*. The central axes of the respective stream-line ribs 14 along the rotational direction of the axial blower are parallel to the tangents of the arcs $\alpha$ n, respectively.

Furthermore, as shown in FIG. 1, the plural stream-line ribs 14 are arranged equidistantly in the radial direction of the blower and the interval of the ribs 14 is set at L/12 relative to the length L of the negative pressure surface-side leading edge portion 13*b* in the radial direction of the blower.

Figure 3:
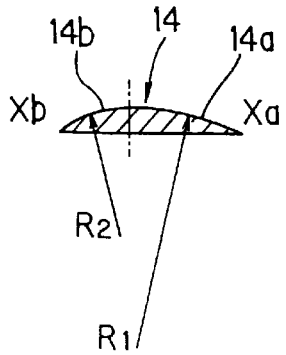
FIG. 3 is a cross-sectional view of a stream-line rib shown in FIG. 2 taken along the line Xa—Xb.

FIG. 3 shows the outer surface (or upper surface in FIG. 3) of the cross-section of the cut portion when each stream-line rib 14, which is cut in the direction of the line Xa—Xb shown in FIG. 1 along the axial direction of the ribs 14 forms a stream-line, arc-shaped cross section. The stream-line rib 14 is formed such that the radius R1 of the arc curve 14*a* at the vane leading edge portion (13*a*) side (or Xa side in FIGS. 1 and 3) end portion is larger than the radius R2 of an arc curve 14*b* at the vane trailing edge portion (13*d*) side (or Xb side in FIGS. 1 and 3) end portion.

Figure 4:
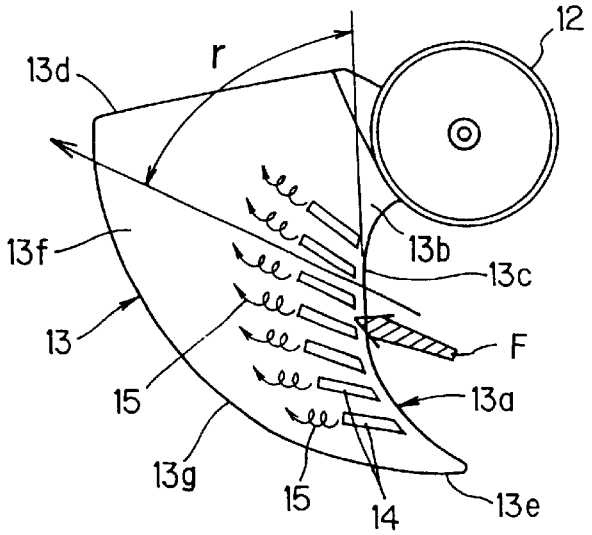
FIG. 4 is a partial front view of the axial blower for describing the function of the embodiment shown in FIG. 1.
Figure 5:
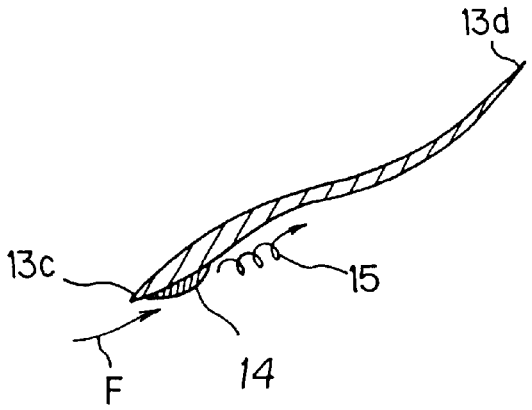
FIG. 5 is a cross-sectional view of a vane shown in FIG. 4 in a circumferential direction.

FIG. 4 is a partial front view showing the function of the axial blower 11 constituted as stated above. FIG. 5 is a cross-sectional view of the axial blower 11 in the circumferential direction of each of the vanes 13. As shown in FIGS. 4 and 5, when an air-flow F travels from the leading edge fillet 13*a* of the vane 13 towards the vane inner surface (13*f*) side as indicated by a large arrow and passes the plural stream-line ribs 14, a plurality of air-flows F form longitudinal vertex rows 15, respectively, as indicated by small arrows and transferred towards a turbulent boundary layer above the vane inner surface 13*f*. The turbulent boundary layer can suppress the separation of flows more than in a case of a laminar boundary layer and makes narrow the widths of the trailing vortexes which cause blowing sound, thus reducing blowing sound.

Figure 6:
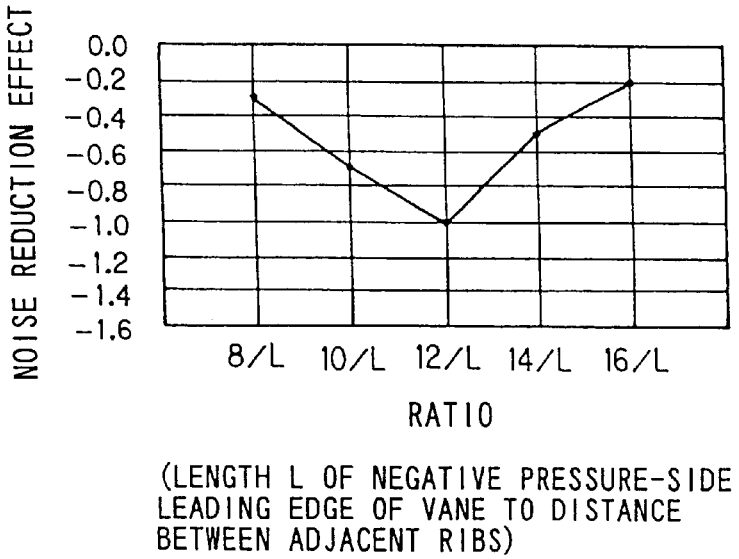
FIG. 6 is a graph showing a relative relationship between a ratio of a length L of the negative pressure-side leading edge portion of the vane to a distance between adjacent stream-line ribs and showing a blowing noise reduction effect of the embodiment shown in FIG.1.

FIG. 6 shows the noise reduction effect in the case where a plurality of stream-line ribs 14 are arranged equidistantly along the radial direction of the blower and the distance between the ribs 14 is set at L/1 with respect to the length L of the negative pressure surface-side leading edge portion 13*b* in the radial direction of the blower. That is, when the axial blower 11 thus formed is incorporated into, for example, the outdoor unit of an air conditioner, the static pressure within the outdoor unit increases. Accordingly, even if the inflow angle γ (see FIG. 4) of the air-flow at the negative pressure surface side leading edge portion 13*b* in the radial direction of the vane be changed, the blowing sound can be reduced.

Figure 7:
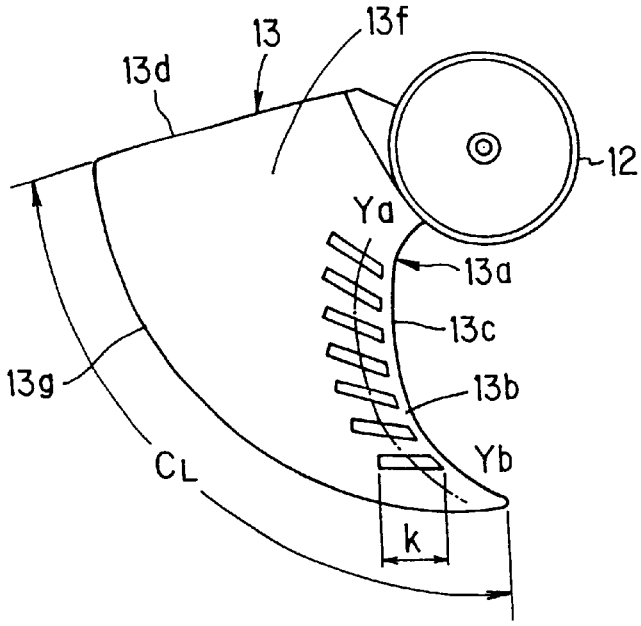
FIG. 7 is a partial front view showing a length k of the stream-line rib at the vane outer periphery side and a length CL of the outer periphery of the vane.

As shown in FIG. 7, the stream-line ribs 14 are formed so that the lengths k of the ribs 14 at the vane outer periphery (13*a*) side in the rotational direction of the blower are equal to one another and the ratio of k to CL is set at k:CL=1:9 where CL is the chord length of a vane outer periphery 13*g*. This can further reduce the blowing noise.

Figure 8:
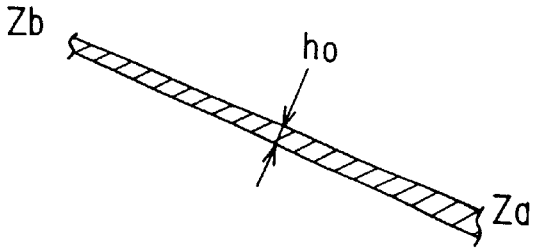
FIG. 8 is a cross-sectional view of the negative pressure surface-side leading edge portion of the vane in the radial direction of the axial blower in one embodiment according to the present invention.

FIG. 8 is a cross-sectional view of the negative pressure surface-side leading edge portion 13*a* of each vane 13 in the radial direction of the blower. The thickness $h_0$ of the cross section is changed so as to become gradually smaller from a hub side Za towards to a vane outer periphery (13*g*) side Zb.

Figure 9:
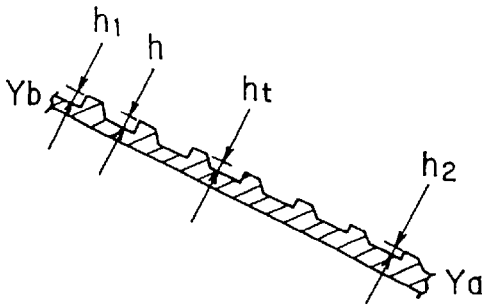
FIG. 9 is a cross-sectional view of the stream-line rib taken along line the line Ya—Yb of FIG. 7.
Figure 10:
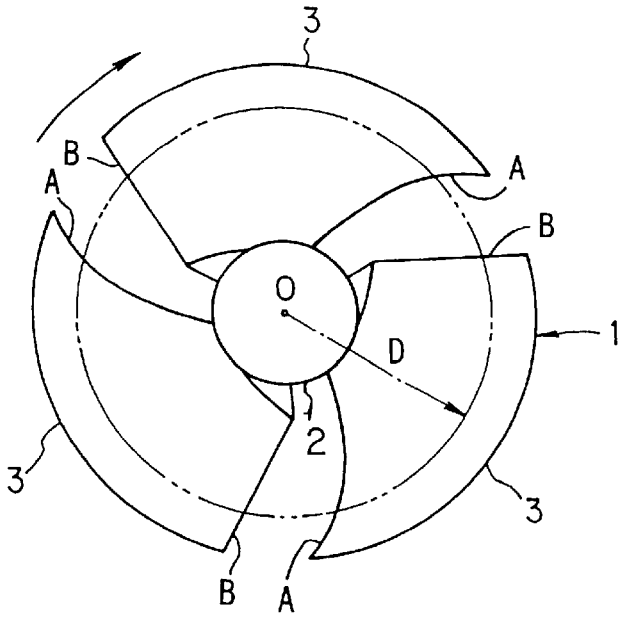
FIG. 10 PRIOR ART
FIG. 10 is a front view of a conventional axial blower as viewed from a vane negative pressure surface side.
Figure 11:
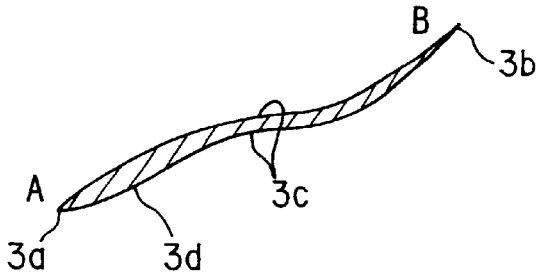
FIG. 11 PRIOR ART
FIG. 11 is a cross-sectional view of the vane when the vane shown in FIG. 10 is circumferentially cut at an arbitrary radius R.
Figure 12:
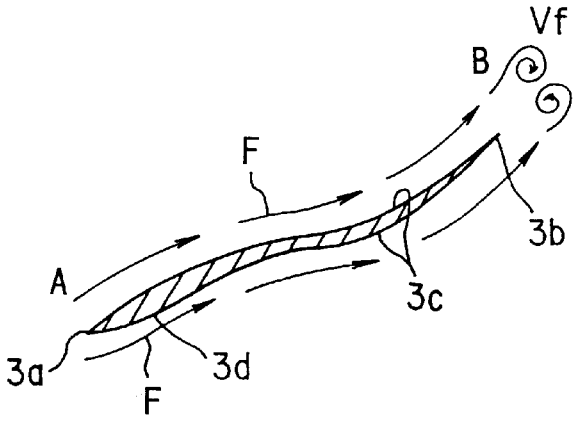
FIG. 12 PRIOR ART
FIG. 12 is a cross-sectional view of the vane showing air flows of the conventional axial blower shown in FIG. 10.

Meanwhile, the height h of each stream-line rib 14 is changed so as to be gradually larger from a hub side Ya towards a vane outer periphery (13*g*) side Yb as shown in FIG. 9. The height $h_1$ of the stream-line rib at the vane outer periphery (13*g*) side and the height $h_2$ of the stream-line rib 14 at the hub side are formed to satisfy the relationship of $h_1=2h_2$. In other words, the direction in which the height h of the stream-line rib 14 increases is exactly opposite to that in which the thickness of the negative pressure surface-side leading edge portion 13*a* increases. The thickness $h_t$ of the cross section including the thickness $h_0$ of the negative pressure surface-side leading edge portion 13*a*, and therefore, becomes equal in any points. As a result, it is possible to shorten a time for cooling the integrally formed axial blower 11 and to reduce the shrinkage thereof while forming the blower 11 with resin and the like.

As described hereinbefore, according to the preferred embodiment of the present invention, a plurality of stream-line ribs smoothly ranging from the negative pressure surface-side leading edge end of each of the vanes are provided at the negative pressure surface-side leading edge portion of the vane and the ribs are arranged such that the central axes thereof pass the points of intersection of the circular arcs about the center of the circular arc portion at the vane outer periphery leading edge side and the leading edge end and are parallel to the tangents of the circular arcs, respectively. Thus, it becomes possible to generate longitudinal vertex rows of air-flows above the vane negative pressure surface and to reduce the blowing sound. It is also possible to improve the formability of the vane due to the stream-line shape of each rib.

It is to be noted that the present invention is not limited to the described embodiment and many other changes and modifications may be made without departing from the scopes of the appended claims.

What is claimed is:

1. An axial blower comprising:

a cylindrical hub;

driving means for rotating the cylindrical hub through a rotational shaft;

a plurality of vanes arranged to an outer peripheral surface of the cylindrical hub in a circumferential direction thereof; and a plurality of stream-line ribs each having a stream-line shape and provided at a leading edge portion of a negative pressure surface-side of each of the vanes in a range from an end portion of the leading edge portion towards a trailing edge portion of the vane, said stream-line ribs being formed integrally such that an outer surface of a cross section of each stream-line rib along a rotational direction of the axial blower forms a circular arc and a radius of a circular arc curve of said outer surface at a vane leading edge side is larger than a radius of a circular arc curve at a vane inner surface side.

2. An axial blower according to claim 1, wherein each of said stream-line ribs has a central axis along the rotational direction of the axial blower, said central axis passing a point of intersection of a circular arc having a center point of a circular arc portion on a vane outer periphery leading edge-side and the leading edge portion and being substantially in parallel to a tangent of the circular arc.

3. An axial blower according to claim 1, wherein said plurality of stream-line ribs are arranged with equal distance from each other and the distance between the adjacent stream-line ribs is set at L/12 with respect to a length L of the leading edge portion along a radial direction of the axial blower.

4. An axial blower comprising:

a cylindrical hub;

driving means for rotating the cylindrical hub through a rotational shaft;

a plurality of vanes arranged to an outer peripheral surface of the cylindrical hub in a circumferential direction thereof; and a plurality of stream-line ribs each having a stream-line shape and provided at a leading edge portion of a negative pressure surface-side of each of the vanes in a range from an end portion of the leading edge portion towards a trailing edge portion of the vane, said stream-line ribs having lengths k at a vane outer periphery side along a rotational direction of the axial blower which are set equal to one another so as to satisfy k:CL=1:9, where CL is a chord length of the vane outer periphery.

5. An axial blower comprising:

a cylindrical hub;

driving means for rotating the cylindrical hub through a rotational shaft;

a plurality of vanes arranged to an outer peripheral surface of the cylindrical hub in a circumferential direction thereof; and a plurality of stream-line ribs each having a stream-line shape and provided at a leading edge portion of a negative pressure surface-side of each of the vanes in a range from an end portion of the leading edge portion towards a trailing edge portion of the vane;

wherein a height of the cross-section of each of the stream-line ribs along a thickness direction of each of the vanes is changed to be made gradually larger from a cylindrical hub side towards a vane outer peripheral direction in a manner reverse to that a thickness of a cross section of the leading edge portion is made gradually smaller from the cylindrical hub side towards the vane outer periphery direction.

6. An axial blower according to claim 5, wherein said plurality of streamline ribs include a stream-line rib closest to a vane outer peripheral side having a height $h_1$ and a stream-line rib closest to the cylindrical hub side of a stream-line rib closest to the vane outer periphery side having a height $h_2$, said heights being set so as to satisfy an equation $h_1=2h_2$).

* * * * *